US007699153B2

(12) United States Patent
Ehrich et al.

(10) Patent No.: US 7,699,153 B2
(45) Date of Patent: Apr. 20, 2010

(54) METHOD FOR IDENTIFYING COUNTERFEIT BANKNOTES

(75) Inventors: Sven Ehrich, Reichertshausen (DE); Karl-Dieter Förster, Deisenhofen (DE); Franz Müller, Munich (DE); Manfred Parussel, Munich (DE); Wolfgang Rapf, Munich (DE); Helmut Karl Reinisch, Munich (DE); Steffen Schmalz, Munich (DE); Helmut Steidl, Munich (DE); Hermann Weilacher, Hebertshausen (DE)

(73) Assignee: Giesecke & Devrient GmbH, Munich (DE)

( * ) Notice: Subject to any disclaimer, the term of this patent is extended or adjusted under 35 U.S.C. 154(b) by 388 days.

(21) Appl. No.: 10/583,768

(22) PCT Filed: Dec. 15, 2004

(86) PCT No.: PCT/EP2004/014299

§ 371 (c)(1),
(2), (4) Date: Jan. 28, 2008

(87) PCT Pub. No.: WO2005/064548

PCT Pub. Date: Jul. 14, 2005

(65) Prior Publication Data

US 2008/0236990 A1 Oct. 2, 2008

(30) Foreign Application Priority Data

Dec. 23, 2003 (DE) ..... 103 60 862

(51) Int. Cl.
*G07F 7/04* (2006.01)

(52) U.S. Cl. ..... 194/206; 194/215

(58) Field of Classification Search ..... 194/350, 194/206, 207, 215–217, 302; 209/534; 235/379
See application file for complete search history.

(56) References Cited

U.S. PATENT DOCUMENTS 7,520,375 B2 * 4/2009 Ina et al. ..... 194/350

(Continued)

FOREIGN PATENT DOCUMENTS

DE 101 07 344 A1 10/2001

(Continued)

OTHER PUBLICATIONS

Search Report of German Patent Office regarding DE 103 60 822 1, Jan. 20, 2005.

*Primary Examiner*—Jeffrey A Shapiro
(74) *Attorney, Agent, or Firm*—Bacon & Thomas, PLLC

(57) ABSTRACT

A method for identifying suspected counterfeit and/or counterfeit banknotes paid into an automatic teller machine, wherein banknotes to be paid in are checked for authenticity on the basis of data from a sensor device. The identification is achieved by linking data from the sensor device concerning the suspected counterfeit and/or counterfeit banknotes to an identity of a payer. The method also includes storing the data concerning the suspected counterfeit and/or counterfeit banknotes and the identity of the payer, and generating checking data for the suspected counterfeit and/or counterfeit banknotes by means of the sensor device or a sensor device similar to the sensor device. The checking data are generated by the sensor device for one or more possible positions of the suspected counterfeit and/or counterfeit banknotes, comparing the checking data with the stored data concerning the suspected counterfeit and/or counterfeit banknotes and determining the data of the suspected counterfeit and/or counterfeit banknote which has the closest agreement with the respective checking data. The method further includes identifying the respective suspected counterfeit and/or counterfeit banknote by means of the identity of the payer, which is linked to the data concerning the suspected counterfeit and/or counterfeit banknote with the closest agreement.

7 Claims, 2 Drawing Sheets

U.S. PATENT DOCUMENTS

Figure 1:
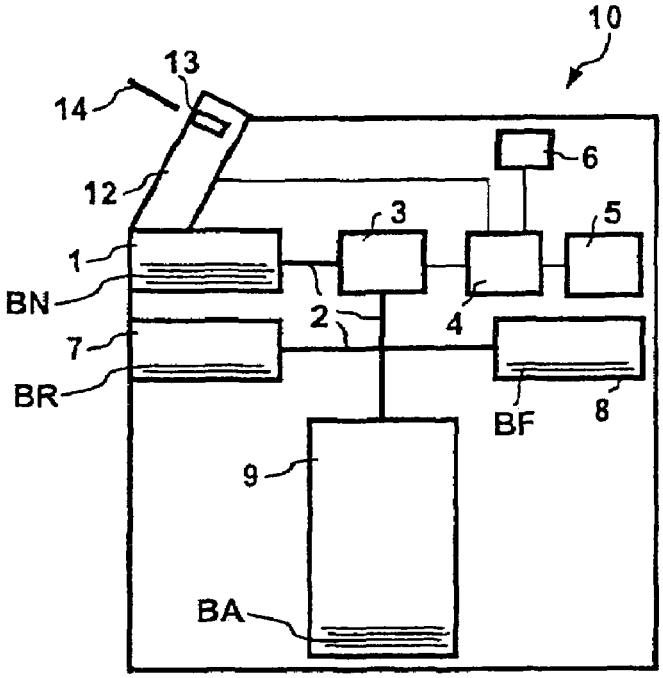

| | | | |
|---|---|---|---|
| 2002/0085745 | A1 | 7/2002 | Jones et al. |
| 2003/0059098 | A1 | 3/2003 | Jones et al. |
| 2003/0159058 | A1 | 8/2003 | Eguchi et al. |
| 2003/0168849 | A1 | 9/2003 | Reinisch |
| 2004/0260650 | A1 | 12/2004 | Nagaya et al. |

FOREIGN PATENT DOCUMENTS

| | | | |
|---|---|---|---|
| DE | 100 29 051 | A1 | 12/2001 |
| EP | 1 122 696 | A1 | 8/2001 |
| EP | 1 128 337 | A1 | 8/2001 |
| EP | 1 349 126 | A2 | 10/2003 |
| WO | WO 00/05688 | | 2/2000 |
| WO | WO 01/18754 | A1 | 3/2001 |
| WO | WO 03/040881 | A2 | 5/2003 |

* cited by examiner

METHOD FOR IDENTIFYING COUNTERFEIT BANKNOTES

The invention relates to a method for identifying suspected counterfeit and/or counterfeit banknotes paid into an automatic teller machine.

On paying banknotes into automatic teller machines, the banknotes paid in are checked with regard to their properties, such as authenticity, condition, type of banknote, i.e. currency and denomination, etc. Depending on the results of the checking, the banknotes may, for example, be accepted, sorted, stored etc. The identification of counterfeit banknotes is particularly significant in this context. In order to recognise banknotes and to distinguish real banknotes from counterfeits, it is usual to derive criteria or comparison data from real banknotes, which allow the recognition of an individual banknote with respect to currency and denomination and the checking of its authenticity. On paying in of banknotes, they are detected by a sensor device and data are generated for the banknotes. The data concerning the banknotes are compared with the comparison data in order to determine their type and their authenticity.

If, during the checking, it is determined that a counterfeit has been input, or at least that a suspected counterfeit is present, the detected counterfeit is separated from the other banknotes and separately stored in order that the counterfeit can be separately checked later. It has thereby proved to be problematic to assign the individual counterfeits to the respective paying in transaction and to the associated payer, in order thereby to be able to draw conclusions about the origin of the counterfeit. These problems arise from the fact that the counterfeits, which can originate from a plurality of paying in transactions, are stored in a separate storage compartment of the automatic teller machine, so that there is no assurance that they are present in the order of the original transactions. For this reason, it is no longer possible at a later time to assign each of the identified counterfeits exactly to the paying in transaction in which it was input into the automatic teller machine.

It is an object of the present invention to provide a method for identifying suspected counterfeit and/or counterfeit banknotes paid into an automatic teller machine, said method making it possible unambiguously to assign banknotes which are identified as being suspected counterfeits on payment into an automatic teller machine to a paying in transaction and/or a payer at a later time.

This aim is achieved according to the invention with a method having the features of claim 1.

With the method according to the invention for identifying suspected counterfeit and/or counterfeit banknotes paid into an automatic teller machine, wherein banknotes to be paid in are checked for authenticity using data from a sensor device, the identification is achieved by linking data from the sensor device for the suspected counterfeit and/or counterfeit banknotes to an identity of a payer, storing the data concerning the suspected counterfeit and/or counterfeit banknotes and the identity of the payer, generating checking data for the suspected counterfeit and/or counterfeit banknotes by means of the sensor device or a sensor device similar to the sensor device, wherein checking data are generated by the sensor device for one or more possible positions of the suspected counterfeit and/or counterfeit banknotes, comparing the checking data with the stored data concerning the suspected counterfeit and/or counterfeit banknotes and determining the data concerning the suspected counterfeit and/or counterfeit banknote, which has the closest agreement with the respective checking data, and identifying the respective suspected counterfeit and/or counterfeit banknote using the identity of the payer, which is linked with the closest agreement to the data concerning the suspected counterfeit and/or counterfeit banknote.

The method according to the invention has the advantage, in particular, that it can be achieved that suspected counterfeit and/or counterfeit banknotes can be assigned at any time to a paying in transaction and/or a payer without this assignment having to be made to the respective banknote or counterfeit at the time of the paying in transaction. In addition, no physical separation of suspected counterfeit or counterfeit banknotes from different paying in transactions or from different payers is necessary. By this means the logistical effort in handling the suspected counterfeit and/or counterfeit banknotes can be substantially reduced. Additionally, the method according to the invention permits the effort required for realising the automatic teller machine to be substantially reduced.

Figure 2:
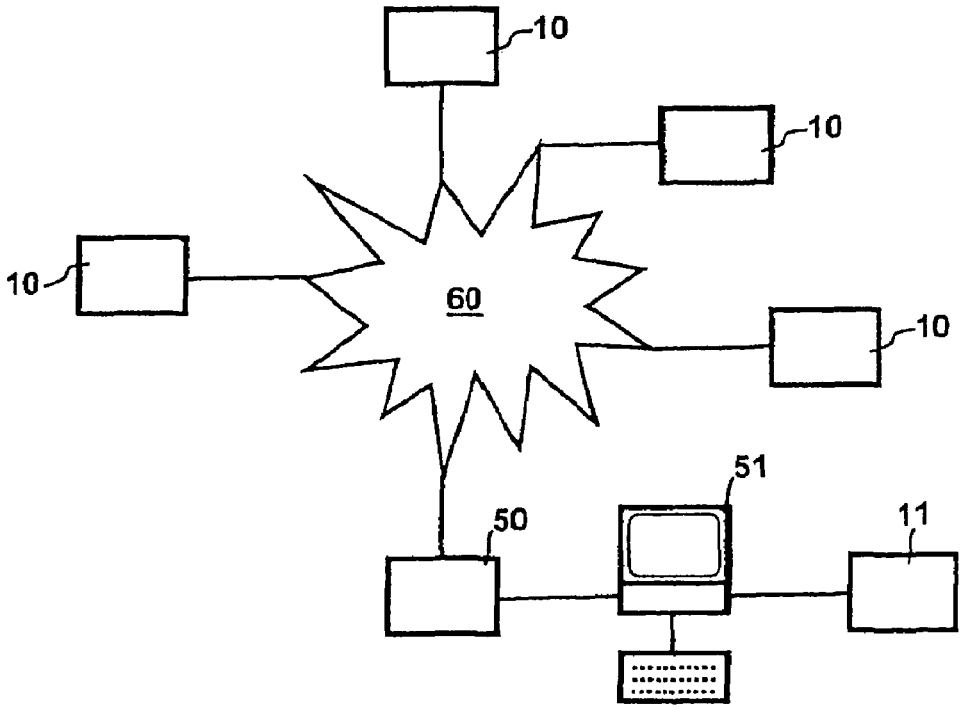
Figure 3:
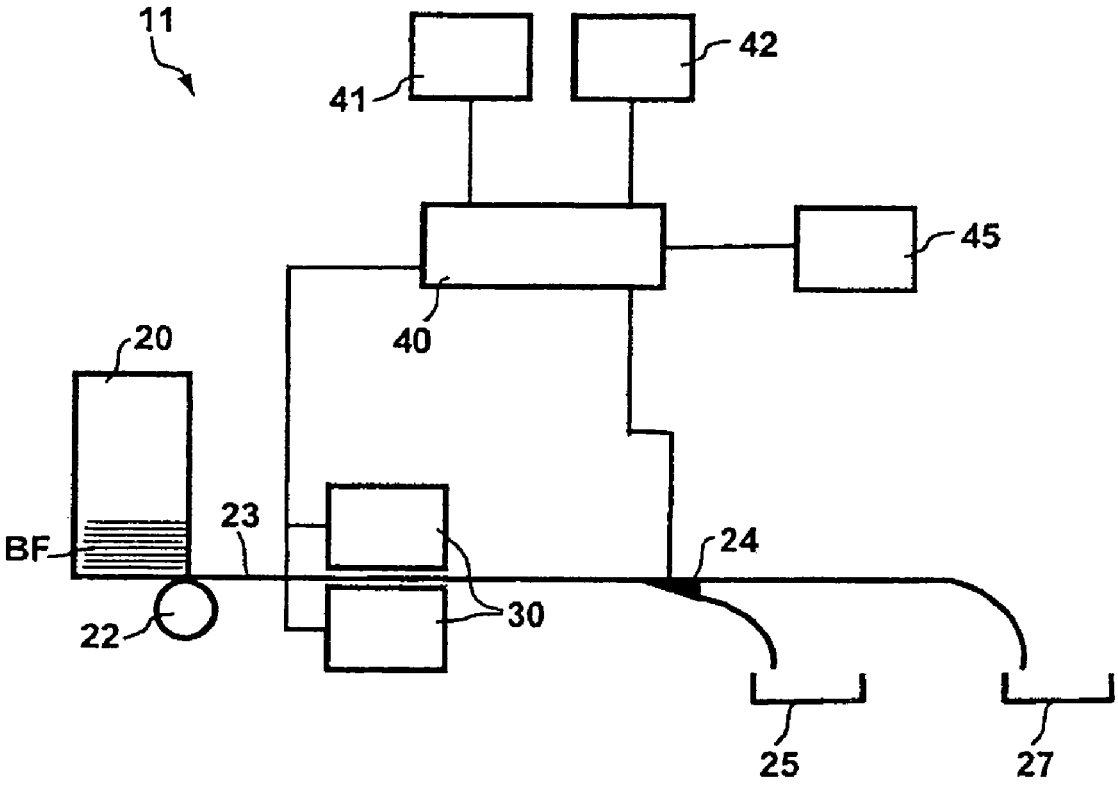

Further advantages of the present invention are disclosed in the dependent claims and in the following description of embodiments, making reference to the drawings, in which:

FIG. 1 shows an automatic teller machine for paying in banknotes and recognising suspected counterfeit and/or counterfeit banknotes, FIG. 2 shows a system for identifying suspected counterfeit and/or counterfeit banknotes, and FIG. 3 shows a banknote processing machine for identifying suspected counterfeit and/or counterfeit banknotes.

FIG. 1 shows a schematic illustration of a design principle of an automatic teller machine 10 for paying in banknotes and recognising suspected counterfeit and/or counterfeit banknotes The automatic teller machine 10 has an input compartment 1 into which banknotes BN to be paid in by a payer are input. The banknotes BN are removed from the input compartment by a transport system 2 and fed to a sensor device 3. In the sensor device 3, features of each individual banknote that are relevant, for example, for assessing the authenticity, type (currency, denomination) and condition of the banknotes are detected. Features of these types may be detected, for example, by various sensors mechanically, acoustically, optically, electrically and/or magnetically. Known authenticity features may be visible and/or invisible and include, for example, printing inks with particular optical and/or magnetic properties, metallic or magnetic security thread, the use of brightening agent-free banknote paper, information contained in an electrical circuit, etc. The type of the banknote is specified, for example, by its size, printed pattern, colours, etc., whereas the condition of the banknotes can be deduced, for example, from the optical image (soiling). The features are detected by the sensor device 3 and relevant data from the sensor device 3 are passed to a control device 4.

The data concerning the detected features are compared by the control device 4 with comparison data which enable the recognition of authentic or suspected counterfeit and/or counterfeit banknotes, the type of the banknotes, the condition of the banknotes, etc. The comparison data and the programs required for operation of the automatic teller machine 10 are present as software and are stored in the control device 4 or in a non-volatile memory store 5 assigned to the control device 4. The non-volatile memory store 5 may comprise, for example, an EEPROM or a flash memory store, a hard disk, or the like. Furthermore, a working memory store (not shown) which is used by the control device 4 for the execution of the software can be linked to the control device 4.

On the basis of the checking of the respective banknote, a deflector (not shown) arranged in the transport system 2 is controlled in order, for example, to deflect suspected counterfeit and/or counterfeit banknotes BF into a storage compartment 8, whereas banknotes BA classified as authentic can be deposited in a cassette 9.

For the control of the automatic teller machine 10 by the payer, an input/output device 12 is linked to the control device 4, in order, for example, to be able to select particular processing modes or to inform the payer about the processing of the paying in transaction. The input/output device 12 also has an identification apparatus 13, for example a reader for a chip card or a magnetic stripe card 14. By inserting his individual card 14, the payer can identify himself to the automatic teller machine and cause the amount corresponding to the paid in banknotes to be credited to his account.

Whenever a suspected counterfeit and/or counterfeit banknote BF is discovered and deposited in the storage compartment 8, the data from the sensor device 3 concerning the relevant banknote BF are stored in the control device 4 or in the non-volatile memory store 5. The data from the sensor device 3 may be the data originating from the individual sensors of the sensor device 3, or they may be data generated by the control device 4 from the data of the sensors, and in particular, the data may be compressed, encrypted, etc. The data may also be processed by the control device 4 so that they contain only particular, informative areas of the banknotes BF. The data from the suspected counterfeit and/or counterfeit banknote BF are also linked to the identity of the payer, for example, thereby that the account number of the payer is added to the data. Further information concerning the paying in transaction may also be added thereto, for example, the date, time and identification number of the automatic teller machine 10, etc. Additionally, further data concerning the counterfeit or suspected counterfeit banknotes BF can be added thereto if they can be generated during the processing, for example, the denomination and position of the respective banknote BF.

In the event that servicing is required, for example, when the cassette 9 is filled with paid in banknotes BA and is changed by a service person, the suspected counterfeit and/or counterfeit banknotes BF are also removed from the storage compartment 8 by the service person in order to pass them on to more precise checking. The service person may, for example, transport the suspected counterfeit and/or counterfeit banknotes BF in a envelope provided with the identification number of the automatic teller machine 10, the date of removal, etc. In addition, the data stored in the non-volatile memory store 5 on the suspected counterfeit and/or counterfeit banknotes BF are made available for more precise checking. This may take place, for example, therein that an interface 6 is provided in the automatic teller machine 10, said interface being linked to the control device 4 and/or the non-volatile memory store 5. The interface 6 may be designed, for example, as a modem, a network connection, an internet connection, a parallel, serial or USB interface, or as a reading device for an optical or magnetic store or the like. It is thereby possible to record the data concerning the suspected counterfeit and/or counterfeit banknotes BF, for example, from a storage medium, a portable computer or the like which the service person carries with him. It is also possible, however, that the data are transferred via the modem, network connection, internet connection, etc., to the site where more precise checking of the suspected counterfeit and/or counterfeit banknotes BF is to be carried out.

FIG. 2 shows a schematic illustration of a design principle for a system for identifying suspected counterfeit and/or counterfeit banknotes.

The system may comprise one or a plurality of automatic teller machines 10 which are connected by means of their interfaces 6 via a network, for example, a telephone network, a local network, the internet or the like, to a checking device which consists of, for example, a computer 51 with an interface 50 and a banknote processing machine 11 whose structure will be described later. The suspected counterfeit and/or counterfeit banknotes BF are transported to the site of the checking device, e.g. a national bank, a police office or the like. At the site of the checking device, the suspected counterfeit and/or counterfeit banknotes BF are checked to discover whether they actually are counterfeits. This may be carried out by suitably trained persons, or by a suitable testing device. Banknotes for which the suspicion of counterfeiting cannot be confirmed can be assigned to the paying in transaction and/or the payer from whom they come so that they can be credited to the appropriate account. Counterfeits must also be assigned to the paying in transaction and/or the payer from whom they come in order to enable localisation of the source of the counterfeits.

In order to be able to assign the suspected counterfeit and/or counterfeit banknotes BF to the paying in transaction and/or the payer from which and/or whom they come, the suspected counterfeit and/or counterfeit banknotes BF must be identified. The bank note processing machine 11, for which a schematic representation of a design principle is shown in FIG. 3 is used for this.

The banknote processing machine 11 has an input compartment 20, in which a separator 22 engages, for the input of the banknotes BF to be identified. The separator 22 grasps one of the banknotes BF to be processed in each case and passes the individual banknote to a transport system 23, which transports the individual banknote through a sensor device 30. The sensor device 30 has a structure which corresponds to the structure of the sensor device 3 of the automatic teller machine 10 and, in particular, it has similar sensors which detect the features of the banknotes BF and generate corresponding checking data for said banknotes, which data are passed on to a control device 40. The checking data of the detected features are compared with comparison data by the control device 40, which data enable the recognition of authentic or suspected counterfeit and/or counterfeit banknotes, the type of the banknotes, the condition of the banknotes, etc. The comparison data and programs needed for operation of the bank note processing machine 11 are present as software and are stored in the control device 40 and/or in a non-volatile memory store 41 assigned to the control device 40. The non-volatile memory store 41 may comprise an EEPROM, a flash memory, a hard disk, etc. Furthermore, a working memory (not shown) may be linked to the control device 40, said working memory being used by the control device 40 for executing the software. Based on the checking of the respective banknote carried out by the control device 40, a deflector 24 arranged in the transport system 23 is controlled in order to deposit the banknote, for example, in output compartments 25 or 27.

For controlling the banknote processing machine 10 by an operator, an input/output device 45 is linked to the control device 40, in order, for example, to be able to select particular processing modes and to inform the operator concerning the processing of the banknotes 21.

The checking data generated during the checking of the banknotes BF by the sensor device 30 may be stored in the non-volatile memory store 41 and/or simultaneously transferred to the computer 51 of the checking device, in order to be stored by it. The checking data may be data originating from the individual sensors of the sensor device 30, although they may also be data generated by the sensor device 40 from the data from the sensors in the manner as described above in connection with the control device 4 of the automatic teller machine 10. For the transfer of the data, an interface 42 is present which can be designed, for example, as a modem, a network connection, an internet connection, a parallel, serial or USB interface, or as a reading device for an optical or magnetic store or the like.

The data concerning the suspected counterfeit and/or counterfeit banknotes BF which come from the automatic teller machine(s) 10 may also be stored in the computer 51 of the checking device. These data have been transferred via the network 60 and the interface 50 to the computer 51. By means of a comparison of the data concerning the suspected counterfeit and/or counterfeit banknotes BF from the automatic teller machine(s) with the checking data from the banknote processing machine 11, the respective suspected counterfeit and/or counterfeit banknotes BF can be identified. For this purpose, the checking data are compared by means, for example, of statistical methods with all the data concerning the suspected counterfeit and/or counterfeit banknotes BF from the automatic teller machine(s). Those data from the suspected counterfeit and/or counterfeit banknotes BF that have the closest agreement serve to identify the suspected counterfeit and/or counterfeit banknotes BF in that the identity of the payer contained in the data concerning the suspected counterfeit and/or counterfeit banknotes BF, such as, for example, the account number of the payer, is used to assign them to the respective banknote BF for which the closest agreement has been detected.

Since normally it is not known in which position the suspected counterfeit and/or counterfeit banknotes BF are fed into the automatic teller machine 10, it is also not known in which position of the banknotes BF the data concerning the suspected counterfeit and/or counterfeit banknotes BF were generated. For this reason, sets of checking data are generated for every possible position of the suspected counterfeit and/or counterfeit banknotes BF. This may be carried out by the banknote processing machine 11 by processing the suspected counterfeit and/or counterfeit banknotes BF in all four positions (front, transport from left; front, transport from right; rear, transport from left; rear, transport from right) in order to generate four sets of checking data for each banknote BF. In this way, it is ensured that comparison of the data concerning the suspected counterfeit and/or counterfeit banknotes BF with the checking data produces a result regardless of the original position of the banknotes BF.

In order to reduce the effort involved in generating the checking data, it may also be provided that only two sets of checking data are generated by the banknote processing machine 11. One set of checking data is obtained by detecting the front side of the banknote, the other by turning the banknote BF over and detecting the rear side. The two missing sets of checking data can be generated in this case by the control device 40 of the banknote processing machine 11 in that the data from the two generated sets of checking data are each evaluated backwards, since this corresponds, in each case, to a set of checking data wherein the banknote BF would have been detected by the sensor device 30 in the respective unused transport direction.

If, in the sensor device 30 of the banknote processing machine 11 used for generating the checking data, all the sensors that scan one of the surfaces of the banknotes are arranged on both sides of the transport system 23, the processing of the suspected counterfeit and/or counterfeit banknotes BF in one position is sufficient, since two sets of checking data, for the front side and the rear side are generated simultaneously. The two missing sets of checking data can then be generated by the control device 30, as described above, by reversing the sequence of the data of the two sets of checking data.

Apart from the embodiment described, a plurality of modifications is possible.

By way of example, a banknote processing machine 11 for the generating of checking data can be dispensed with if the automatic teller machine 10 itself is used for generating the checking data. For this purpose, a special operating mode may be provided which enables the service person, who authenticates himself, for example, with a special card 14, to generate the checking data, as described above for the banknote processing machine 11. The checking device with the computer 51 can also be dispensed with if the identification of the banknotes BF is carried out by means of the control device 4.

A further possibility is to dispense with the computer 51. In this case, the control device 40 of the banknote processing machine 11 is used for identifying the banknotes BF.

Furthermore, during their processing in the automatic teller machine 10, the banknotes can be transported by the transport system 2 along their long edges or their short edges. It is obvious that the banknotes must also be transported accordingly along their long edges or their short edges by the transport system 23 in the banknote processing machine 11, since this has consequences for the data generated by the sensor devices 3 and 30.

In deviation from the procedure for transferring data concerning the suspected counterfeit and/or counterfeit banknotes BF described by reference to FIG. 2 via a network 60, the data concerning the suspected counterfeit and/or counterfeit banknotes BF may also be transferred by means of a storage medium which is transported together with the suspected counterfeit and/or counterfeit banknotes BF to the checking site.

In order to lessen the effort required for identifying the banknotes BF, it may be provided that the identification number of the automatic teller machine 10 from which the banknotes BF originate is used. In this case, only the data having this identification number concerning the suspected counterfeit and/or counterfeit banknotes BF are used for the comparison with the checking data.

The effort required for identifying the banknotes BF can be further lessened if the additional data concerning the suspected counterfeit and/or counterfeit banknotes BF, such as denomination and/or position, are used during the checking. In this event, only the data concerning the suspected counterfeit and/or counterfeit banknotes BF are compared with the checking data for which the denomination and/or position agree.

If the information concerning the original position is used, it may be sufficient when detecting all the possible positions for generating the checking data, to detect only the known original position of the banknote BF. In this event, however, it must already be known, which position is assigned to which banknote BF.

The invention claimed is:

1. Method for identifying suspected counterfeit banknotes paid into an automatic teller machine, wherein banknotes to be paid in are checked for authenticity on the basis of data from a sensor device, comprising the steps of:

linking data from the sensor device for the suspected counterfeit banknotes to an identity of a payer, storing the data concerning the suspected counterfeit banknotes and the identity of the payer, generating checking data for the suspected counterfeit banknotes by means of the sensor device, wherein checking data are generated by the sensor device for one or more of the possible positions of the suspected counterfeit banknotes, comparing the checking data with the stored data concerning the suspected counterfeit banknotes and determining the data concerning the suspected counterfeit banknote which has the closest agreement with the respective checking data, and identifying the respective suspected counterfeit banknote using the identity of the payer which is linked with the closest agreement to the data concerning the suspected counterfeit banknote.

2. Method according to claim 1, wherein the suspected counterfeit banknotes are processed by means of the banknote processing machine for the generating of checking data for all one or more positions.

3. Method according to claim 1, wherein an identification number is used for each automatic teller machine, said identification number being linked to the data from the sensor device concerning the suspected counterfeit banknotes and that, for the identification of suspected counterfeit banknotes, only data concerning suspected counterfeit banknotes which have a particular identification number are compared with the checking data.

4. Method according to claim 1, wherein data from the sensor device concerning the suspected counterfeit banknotes are linked to additional data concerning the banknotes which were determined while being paid in, and that during identification of suspected counterfeit banknotes, only those checking data which have matching additional data are compared with the data concerning suspected counterfeit banknotes.

5. Method according to claim 4, wherein the suspected counterfeit banknotes are processed by means of the banknote processing machine in one of the possible banknote positions, which is given in the additional data.

6. Method according to claim 1, wherein the sensor device has at least one sensor device, and wherein the data of the sensor device concerning the suspected counterfeit banknotes comprises data from the at least one sensor device.

7. Method according to claim 1, wherein the sensor device for determining the authenticity of the banknotes detects features that are visible or invisible.

* * * * *